US006392678B2

(12) United States Patent
Nakamura et al.

(10) Patent No.: US 6,392,678 B2
(45) Date of Patent: May 21, 2002

(54) ELECTROPHORETIC PRINTING METHOD AND ELECTROPHORETIC PRINTER

(75) Inventors: Masanari Nakamura; Hirokazu Nakayama, both of Shizuoka (JP)

(73) Assignee: Star Micronics Co., Ltd., Shizouka (JP)

( * ) Notice: Subject to any disclaimer, the term of this patent is extended or adjusted under 35 U.S.C. 154(b) by 0 days.

(21) Appl. No.: 09/748,823

(22) Filed: Dec. 27, 2000

(30) Foreign Application Priority Data

Dec. 28, 1999 (JP) ..... 11/372972

(51) Int. Cl.[7] ..... B41J 2/41; G09G 3/34
(52) U.S. Cl. ..... 347/112; 345/107; 359/296
(58) Field of Search ..... 347/111, 112, 347/153; 345/107; 359/296

(56) References Cited

U.S. PATENT DOCUMENTS 5,389,945 A * 2/1995 Sheridon ..... 345/107 X
5,724,064 A * 3/1998 Stefik et al. ..... 345/107 X
5,866,284 A * 2/1999 Vincent ..... 359/296 X
6,081,285 A * 6/2000 Wen et al. ..... 347/111

FOREIGN PATENT DOCUMENTS

JP 52-28354 B 7/1977
JP 01086116 3/1989
JP 6-35370 * 2/1994

* cited by examiner

*Primary Examiner*—Joan Pendegrass
(74) *Attorney, Agent, or Firm*—Scully, Scott, Murphy & Presser

(57) ABSTRACT

An electrophoretic printing method comprises layering a back electrode and a dispersion system containing electrophoretic particles on a printing substrate to form a printing layer; and providing a printing head separately from the printing substrate. The printing head has a front electrode which is a counterpart of the back electrode and which has a predetermined printing pattern. The front electrode is brought into contact with the printing layer formed on the printing substrate to oppose the back electrode. Voltage is applied between the front electrode and the back electrode so as to change a distribution of the electrophoretic particles according to the polarity of the voltage and to form a desired image on the dispersion system.

8 Claims, 3 Drawing Sheets

ELECTROPHORETIC PRINTING METHOD AND ELECTROPHORETIC PRINTER

BACKGROUND OF THE INVENTION

1. Technical Field

The present invention relates to a printing method and to a printer for repeatedly printing desired variable images on recording substrates by utilizing an electrophoretic display method.

2. Background Art

Electrophoretic displays (hereinafter referred to as "EPD") are a non-emitting type display which utilizes electrophoresis of charged particles (electrophoretic particles) dispersed in a dispersion medium, and they have characteristics which are not provided by liquid crystal displays, such as high contrast, wide viewing angle, long duration of display without electric power supply, reduced electric power consumption, and the like.

EPDs are known in Japanese Patent Publication, No. 52-28354 and Japanese Patent No. 2551783. According to a basic feature of the EPD, a medium dispersing electrophoretic particles therein is enclosed between a pair of opposing electrode layers of which at least one is transparent, and the surface of the transparent electrode layer serves as a viewing surface.

When a voltage for producing a display is applied between the electrode layers, a displaying movement, in which the electrophoretic particles are drawn to one of the electrode layers, is performed. A viewer recognizes the electrophoretic particles or the medium as an image. In an actual image display, one of the electrode layers is divided into a specific display pattern, and the polarity of voltage applied to each divided electrode layer is separately controlled. In this way, contrast between the electrophoretic particles and the medium is produced, thereby forming a desired image.

The EPD is considered to have rewritable properties in which erasing and printing of images can be repeated usually by controlling the polarity of the voltage applied between a pair of electrode layers. The inventors have intensively researched the possibility of applying a new rewriting method utilizing the electrophoretic display system. Printing substrates for rewriting may be applied to recording media, and the like, to which variable information is recorded. For example, point cards to which points corresponding to purchase amounts are added and are displayed, consultation cards on which the next consultation date and time are displayed, and other types of cards may be mentioned. The electrophoretic display system may be applied to display contents of data or reminders of the capacity of floppy disks (FD), optical magnetic recording disks (MO), and Zip disks, and the like, which are used for backup or delivery of various types of data in computer environments.

In order to apply the electrophoretic display system to such recording media, it may easily be anticipated that the EPD may be installed on the surface of the media. In such a manner, however, one of the electrode layers, which is divided into a display pattern, is relatively complicated, and the circuit for applying a voltage to the divided electrode layer is complicated. This makes the cost of the media very high, and use thereof may therefore not be practical.

SUMMARY OF THE INVENTION

The invention has been made in consideration of the above situation. An object of the present invention is to provide an electrophoretic printing method and an apparatus which can easily rewrite images on printing substrates such as cards and magnetic recording media at low cost, and the cost of the printing substrates can be held down.

The inventors have noted that, without an electrode layer for causing displaying movement, the remaining other electrode layer and the dispersing system can be only a paper-like recording medium, which is low cost. The inventors found that images can be displayed similarly to those in EPDs and that the objects of the invention can be effectively accomplished by separating the electrode layer for causing displaying movement and by contacting that electrode layer to the dispersion system to apply a voltage across the two electrodes during printing.

The invention has been made based on the above. The invention provides an electrophoretic printing method comprising: layering a back electrode and a dispersion system containing electrophoretic particles on a printing substrate to form a printing layer; and providing a printing head separately from the printing substrate. The printing head has a front electrode which is a counterpart of the back electrode and which has a predetermined printing pattern. The front electrode is brought into contact with the printing layer formed on the printing substrate to oppose the back electrode. Voltage is applied between the front electrode and the back electrode so as to change a distribution of the electrophoretic particles according to the polarity of the voltage and to form a desired image on the dispersion system.

According to the invention, the printing head contacts the printing layer formed on the printing substrate and applies a voltage between the front electrode and the back electrode so that the dispersing system performs displaying movement and repeatedly forms images. That is, the invention can perform rewriting. The printing substrate referred to is an object to be printed, for which the above-mentioned cards and magnetic recording media may be mentioned as examples.

In the invention, the printing layer comprises the back electrode and the dispersion system serves as a medium for printing. The printing layer may be formed on plural printing substrates, which may be printed by one printing head. Therefore, images can be easily rewritten on the printing substrates at low cost, and the cost of the printing substrate can be held down. Furthermore, clear images can be obtained since the dispersing system can be viewed directly rather than the dispersing system being viewed through a transparent electrode layer as in EPDs, so that the quality of the images can be increased. Moreover, since a printing method by application of voltage is used rather than a printing method using magnetism or heating, printing can be safely performed even if the printing substrate is a magnetic recording medium which is affected by magnetism or a medium such as a rewritable CD which is readily affected by heat.

The front electrode in the invention is divided into a specific printing pattern. A desired image is formed on the dispersion system by selectively applying voltage to the front electrode. On the other hand, the image is erased by applying voltage to the front electrode entirely.

When the front electrode consist comprises only the printing electrode having a specific printing pattern, the printing pattern of the front electrode must be opposed to the printed image with high precision during contacting the printing head to the printing layer for rewriting in order to completely erase the printed image. However, errors readily occur in such positioning, and further printing may be performed on an incompletely erased portion, and the images may therefore be unclear.

Therefore, in order to avoid the above-mentioned problems, the front electrode may comprise a printing electrode for forming a variable desired image and a marginal electrode disposed around the printing electrode to form a marginal image. According to the preferable feature, incomplete erasure can be avoided since the marginal electrode erases the circumference of the printed portion printed by the printing electrode. As a result, clear rewritten images can be obtained even if a printed image is inadequately positioned relative to the printing head.

According to a preferable feature of the invention, the printing head may comprise a contact electrode for applying voltage to the back electrode at substantially the same plane as the printing electrode. Since the printing surface of the printing head comprises the printing electrode and the contact electrode, the design of the electrodes, specifically the contact electrode, can be simplified. Moreover, the feature allows simultaneous thrusting by the electrodes to the back electrode and the printing surface, and reliable printing can be performed.

According to a preferable feature of the invention, at least one pre-printing cycle may be performed on the dispersion system before a desired image is formed thereon. In the pre-printing, the entire surface of the dispersion system is printed, and then the entire surface of the dispersion system is erased. The pre-printing cycle activates the electrophoresis of the electrophoretic particles in the dispersion system, so that the subsequent printing movement of the electrophoretic particles, that is, the drawing of the electrophoretic particles to the front electrode or the back electrode is reliably performed. As a result, the printed images have a high contrast appearance.

According to a preferable feature of the invention, the voltage applied between the electrodes is divided into pulses, and the pulses are repeatedly applied thereto. When the voltage pulses are repeatedly applied, the electrophoretic particles are repeatedly electrophoresed in the vicinity of the printing electrode to which the electrophoretic particles are drawn, and are activated similarly to the case in which the pre-printing is performed.

The invention further provides an electrophoretic printing apparatus for printing on a printing substrate having a printing layer thereon comprising a back electrode and a dispersion system containing electrophoretic particles. The apparatus comprises: a printing head provided separately from the printing substrate. The printing head has a front electrode which is a counterpart of the back electrode and which has a predetermined printing pattern. The front electrode is brought into contact with the printing layer formed on the printing substrate to oppose the back electrode. Voltage is applied between the front electrode and the back electrode so as to change a distribution of the electrophoretic particles according to the polarity of the voltage and to form a desired image on the dispersion system.

The electrophoretic printing apparatus has the same advantages and may have the same preferable features as those provided by the above-mentioned printing method.

DETAILED DESCRIPTION OF THE INVENTION

Figure 1:
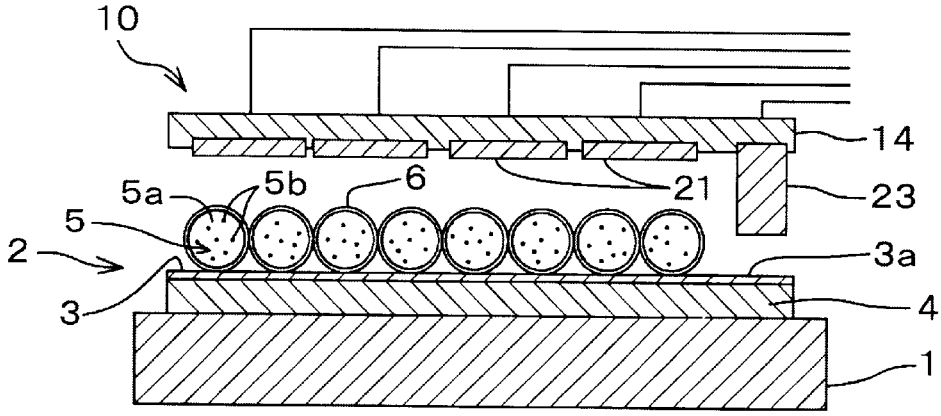
FIG. 1 is a cross section showing the condition in which a printing substrate is opposing the printing head and is apart therefrom for explaining rewriting method according to an embodiment of the invention.

The invention will be explained in more detail hereinafter with reference to the drawings. Reference numeral 1 in FIGS. 1 and 2 denotes a printing substrate made of resin material formed into a thin plate. The printing substrate 1 may be a casing for magnetic recording media such as cards, FD, MO, or Zip disks. A printing layer 2 is formed on a surface of the printing substrate 1. The printing layer 2 comprises a PET (polyethylene terephthalate) film 4 adhered to the printing substrate 1, a back electrode 3 layered on the PET film 4, and a dispersion system 5 layered on the back electrode 3. The back electrode 3 is formed of conductive materials such as ITO (indium tin oxide). The conductive materials such as ITO may be layered on the PET film 4 by thin film forming methods such as vapor deposition and sputtering, or may be coated by a suitable coating method by mixing it into a coating material.

Reference numeral 3*a* denotes a terminal portion, and the other portion of the back electrode 3 is laid with the dispersion system 5.

The dispersion system 5 is a fluid in which electrophoretic particles 5*b* are dispersed in a dispersion medium 5*a*, which are enclosed in large numbers of spherical microcapsules 6. A single layer of the microcapsules 6 is put on the front surface of the back electrode 3. As the dispersion medium 5*a*, water, alcohol, hydrocarbons, halogenated hydrocarbons, or natural or synthetic oils may be used. As the electrophoretic particles 5*b*, colloidal powders and fine powders of organic or inorganic pigments, dyes, metallic powders, glass or resins may be used.

The dispersion system 5 may include charging control agents which consist of particles such as electrolytes, surface activating agents, metallic soaps, resins, rubbers, oils, varnishes, or other compounds, if necessary, and dispersion agents, lubricating agents, and stabilizers may be suitably added thereto. In the dispersion system 5, drawing properties of the electrophoretic particles 5*b* with respect to the electrode and the viscosity thereof are suitably controlled.

The dispersion medium 5*a* having suitable amounts of electrophoretic particles 5*b* dispersed therein is mixed and controlled into the dispersion system 5 by mixing apparatuses such as ball mills, sand mills, and paint shakers. The dispersion system 5 is enclosed in microcapsules 6 by suitable methods such as interfacial polymerization, insoluble reaction methods, phase separation methods, and interfacial sedimentation methods. As materials for the microcapsule 6, a mixture of gelatin and arabic gum is preferably used. In the microencapsulation of the dispersion system 5, the volume resistivities of the shell of the microcapsule 6 and the dispersion system 5 are preferably equal.

In order to layer the dispersion system 5, which is microencapsuled, on the back electrode 3, screen printing, roller printing, and spraying may be used. A protective layer (not shown) made of a transparent resin is preferably provided on the microcapsule 6 layer to protect it.

Figure 3:
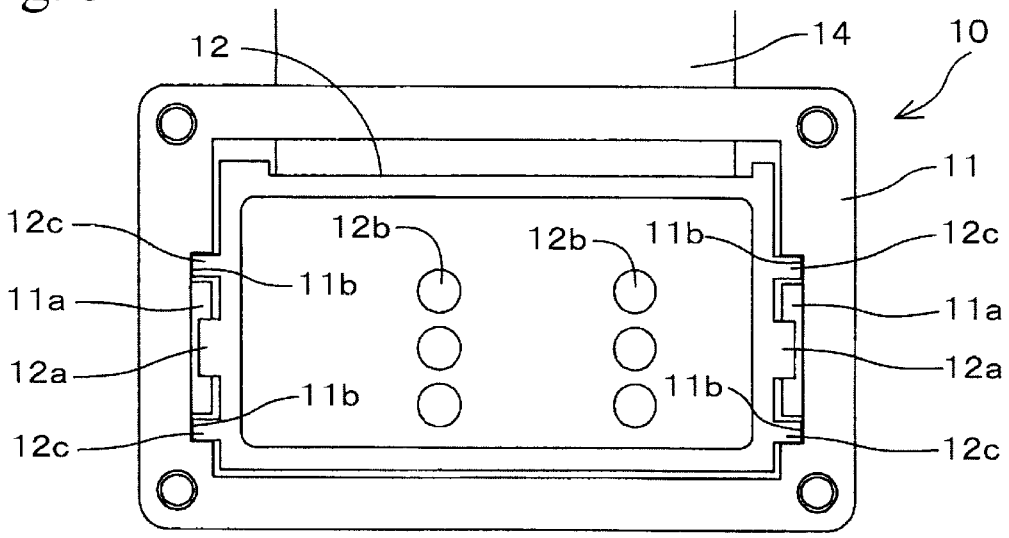
FIG. 3 is a reverse view of the printing head according to the embodiment of the invention.
Figure 4:
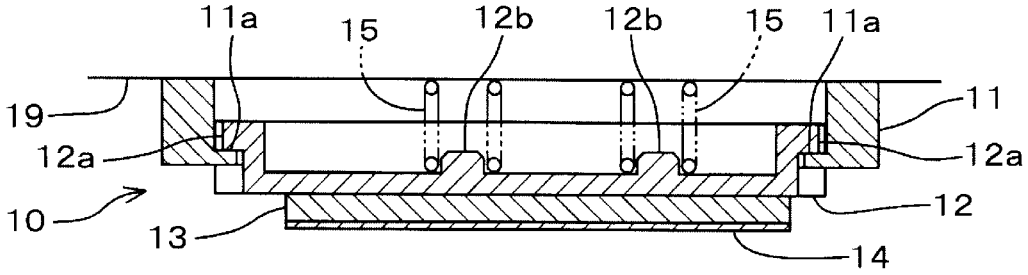
FIG. 4 is a cross section of the printing head.
Figure 5:
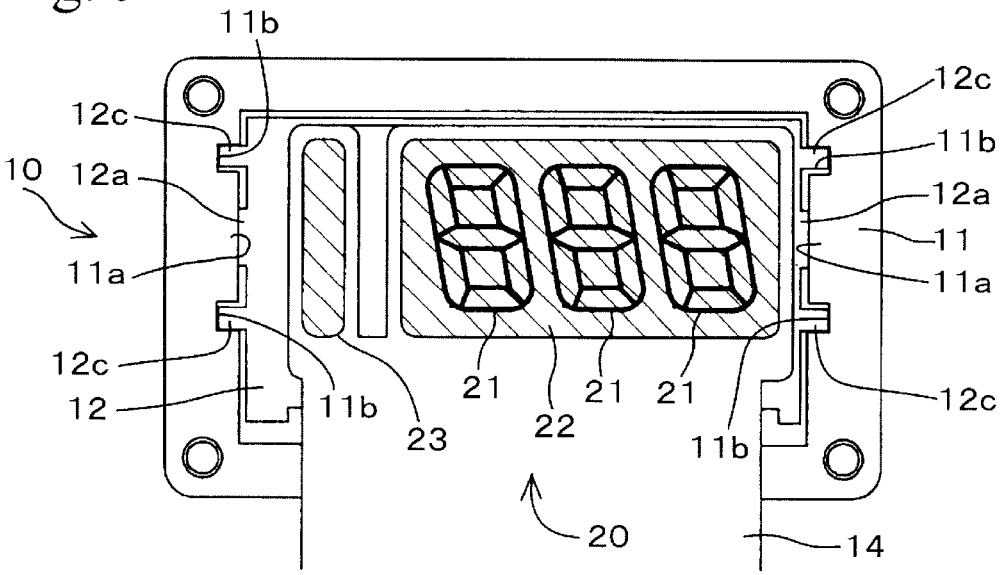
FIG. 5 is a plane view showing the front surface of the printing head.

FIGS. 3 to 5 show a printing head 10 for performing erasing and printing of images on the printing layer 2. The printing head 10 is installed in an apparatus in which the printing substrate 1 is removably inserted. When the printing substrate 1 is a magnetic recording medium such as a Zip disk, the apparatus may be a driver for the medium. The printing head 10 comprises a casing 11 formed into a rectangular frame. A tray-shaped holder 12 is contained in the casing 11. A flexible electrode sheet 14 is adhered to the front surface (lower surface in FIG. 4) of the holder 12 via an elastic sheet member 13. As shown in FIG. 4, the printing head 10 is secured to a plate-shaped part 19 of the apparatus into which the printing substrate 1 is inserted so that the reverse surface (upper surface in FIG. 4) of the casing 11 may face the plate-shaped part 19.

The holder 12 is movable in the thickness direction thereof, and is biased to the front surface by coiled springs 15 disposed between the bottom portion thereof and the plate-shaped part 19. The holder 12 comprises protrusions 12*a* at both ends, and is held at the position in which the protrusions 12*a* engage stoppers 11*a* of the casing 11. The coiled spring 15 is fitted to a protrusion 12*b* formed on the bottom portion of the holder 12 so as to be held at the position thereof. In this condition, the front surface of the holder 12 projects from the casing 11 to a certain extent, and the flexible electrode sheet 14 also projects from the front surface of the casing 11. The holder 12 comprises claws 12*c* formed at the opposite sides of the protrusion 12*a*, and are fitted into recesses 11*b* formed on the inner surface of the casing 11 so as to restrict the horizontal movement thereof in FIG. 4.

Front electrode 20 which is a counterpart of the back electrode 3 of the printing layer 2 is formed and exposed on the flexible electrode sheet 14 at the portion where the electrode sheet 14 is adhered to the holder 12. As shown in FIG. 5, the front electrode 20 comprises a printing electrode 21 for printing images of 3-digits numerals, a marginal electrode 22 disposed around the printing electrode 21 so as to print marginal images, and a contact electrode 23 for contacting the terminal portion 3*a* of the back electrode 3. The electrodes 21 to 23 and the front electrode 20 are formed on the same plane. The printing electrode 21 for printing one digit of a numeral is divided into seven segments which form the numeral "8" so as to allow printing of numerals "0" to "9" by selecting the segments. The flexible electrode sheet 14 extends flexibly from the portion where it is adhered to the holder 12, and that portion is equipped with a circuit (not shown) for providing voltage to the electrodes 21 to 23 of the front electrode 20. The end of the flexible electrode sheet 14 is connected to an output portion in the apparatus. The front electrode 20 and the circuit are formed of metallic foils such as copper foils, silver foils, or the conductive films used in the back electrode 3.

Figure 2:
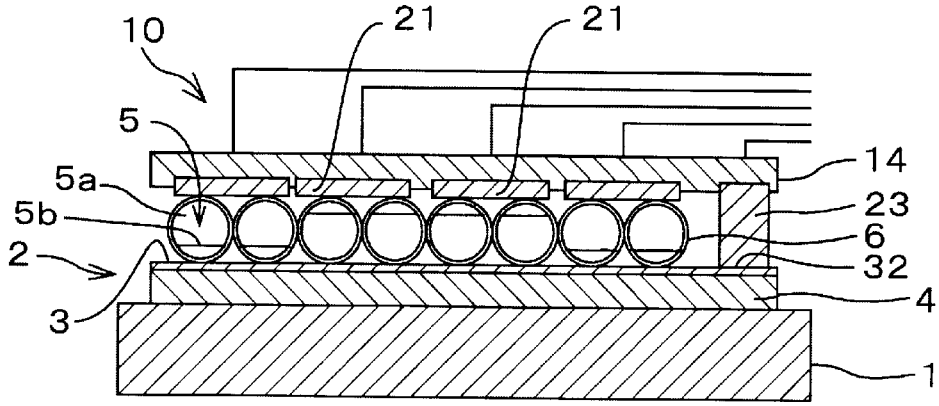
FIG. 2 is a cross section showing the condition in which a printing substrate is in contact and printing is completed for explaining the rewriting method according to an embodiment of the invention.

The printing head 10 is disposed in the portion of the apparatus into which the printing substrate 1 is inserted. When the printing substrate 1 is inserted into the apparatus, the microcapsules 6 of the printing layer 2 is thrust and contacted to the printing electrode 21 and the marginal electrode 22, and the terminal portion 3*a* of the back electrode 3 are thrust and contacted to the contact electrode 23, with a certain amount of a pressure, respectively. FIGS. 1 and 2 show the printing electrode 21 and contact electrode 23 of the printing head 10. FIG. 1 shows a condition in which the printing substrate 1 is disposed opposing and apart from the printing head 10. FIG. 2 shows the condition in which the printing substrate 1 moves toward the printing head 10 from the condition in FIG. 1 and into contact therewith. The front electrode 20 is flexibly movable together with the holder 12 in the thickness direction thereof, and reliably contact the printing layer 2 since it is provided on the holder 12 via the elastic member 13.

The following is a description of an operation for printing numerals as specific information on the printing layer 2 of the printing substrate 1 by the printing head 10. First, the printing substrate 1 is inserted into the apparatus, and the printing layer 2 comes into contact with the printing head 10 as shown in FIG. 2. Then, voltage is applied between the back electrode 3, and the printing electrode 21 and the marginal electrode 22; negative voltage is first applied between the printing electrode 21 and the marginal electrode 22 so as to erase the entire printing layer 2. The erasing is performed by all the electrophoretic particles 5*b* in the dispersion system 5 being drawn to the back electrode 3. Then, positive voltage is applied to only the segments to be printed of the printing electrode 21.

Figure 6:
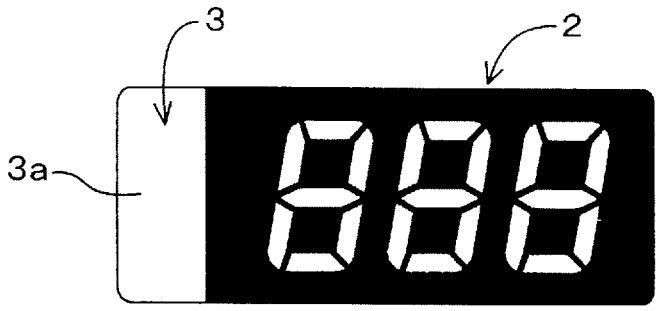
FIG. 6 is a plane view showing the printing layer on which numerals are printed.

As a result, as shown in FIG. 2, the electrophoretic particles 5*b* facing the applied segments are drawn thereto. After completion of this printing movement, the printing substrate 1 is ejected from the apparatus. The specific numerals are printed in the printing layer 2 of the printing substrate 1 by the electrophoresis of the electrophoretic particles 5*b* in the dispersion system 5. FIG. 6 shows the condition in which positive voltage is applied to all the segments of the printing electrode 21 and the numerals "888" are printed in the printing layer 2. When the printing substrate 1 is a magnetic recording medium such as a Zip disk, the numeral may preferably be the remainder of the capacity thereof.

Figure 7:
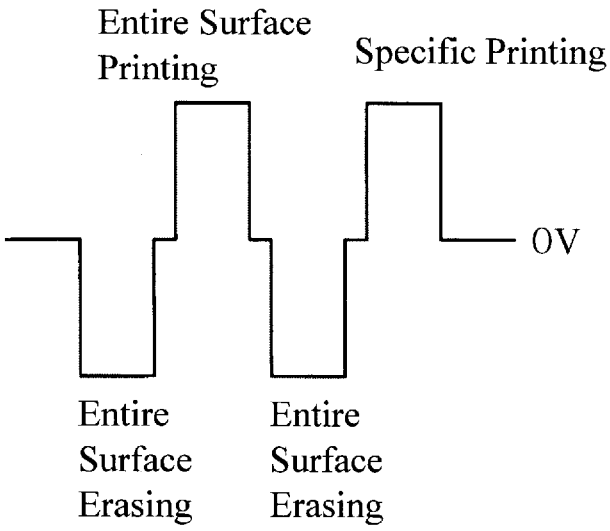
FIG. 7 is a drawing showing a pre-printing cycle for applying voltage.

The above-mentioned applying cycle, in which after erasing the entire surface, the specific numerals are printed, is a basic cycle for rewriting. A pre-printing cycle, in which after erasing the entire surface, the entire surface is printed, then the entire surface is again erased, is preferably performed for at least one cycle. FIG. 7 shows this printing cycle. In the printing cycle, the electrophoresis of the electrophoretic particles 5*b* in the dispersion system 5 is activated, the drawing of the electrophoretic particles 5*b* is reliably performed, and the printed images therefore appears to have high contrast. The applying time for erasing and printing may be approximately a few hundreds of milliseconds.

Figure 8:
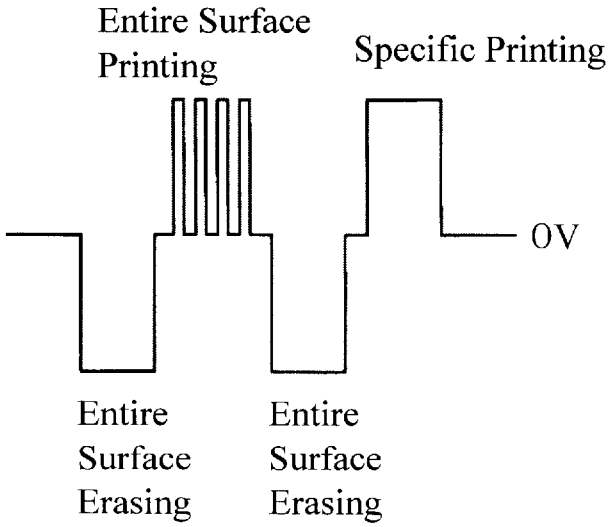
FIG. 8 is a drawing showing a printing cycle for applying voltage pulses.

In order to activate the electrophoretic particles 5*b*, the applying voltage for the entire printing and the specific printing is preferably divided into pulses and the pulses are repeatedly applied. FIG. 8 shows this printing cycle. By applying voltage in this manner, the electrophoretic particles 5*b* are repeatedly electrophoresed and activated in the vicinity of the printing electrode 21 to which the electrophoretic particles 5*b* are drawn, so that the printed images have higher contrast.

In the above embodiment, the printing layer 2 comprising back electrode 3 and the dispersion system 5 serve as a medium for printing. The printing layer 2 is formed on plural printing substrates 1, which are printed by one printing head 10. Therefore, images or numerals can be easily rewritten at low cost, and the cost of the printing substrate 1 can be held down. Furthermore, clear images can be obtained since the dispersing system 5 is viewed directly rather than a dispersing system being viewed through a transparent electrode layer as in EPDs.

The front electrode 20 of the printing head 10 comprises the printing electrode 21 for printing numerals and the marginal electrode 22 disposed around the printing electrode 21 for forming marginal images, so that images are completely erased by erasure of the entire surface by both electrodes. Therefore, incomplete erasure is avoided even if a printed image is inadequately positioned relative to the printing head 10, so that clear rewritten images can be obtained. Moreover, since the printing method by applying voltage is used instead of a printing method using magnetism or heating, printing can be performed with no problem even if the printing substrate 1 is a magnetic recording medium which is affected by magnetism or a medium which is readily affected by heat such as a rewritable CD.

This embodiment is a system in which the printing head 10 is installed in an apparatus into which the printing substrate 1 is inserted and specific images are printed on the inserted printing substrate 1. The invention is not limited to the above system, and several types of systems are within the scope of the invention. For example, the printing head 10 may be a hand-held type for use while being held in the hand, and the front electrode 20 of the printing head 10 is thrust to the printing layer 2 of the printing substrate 1 for rewriting. Moreover, images are not limited to numerals, and multiple types of images such as alphabets, symbols, and patterns can be printed.

As is mentioned in the above, the invention provides a new rewriting method and apparatus utilizing the electrophoretic display system. According to the method and apparatus, rewriting on printing substrates can be easily performed at low cost, and the cost of the printing substrate can be held down.

What is claimed is:

1. An electrophoretic printing method comprising:

layering a back electrode and a dispersion system containing electrophoretic particles on a printing substrate to form a printing layer; and providing a printing head separately from the printing substrate, the printing head having a front electrode which is a counterpart of the back electrode and which has a predetermined printing pattern;

wherein the front electrode is brought into contact with the printing layer formed on the printing substrate to oppose the back electrode, and voltage is applied between the front electrode and the back electrode so as to change a distribution of the electrophoretic particles according to the polarity of the voltage and to form a desired image on the dispersion system; and the front electrode comprises a printing electrode for forming a variable desired image and a marginal electrode disposed around the printing electrode for forming a marginal image.

2. An electrophoretic printing method according to claim 1, wherein the front electrode further comprises a contact electrode for applying voltage to the back electrode at substantially the same plane as the printing electrode.

3. An electrophoretic printing method according to claim 2, wherein the voltage applied between the electrodes is divided into pulses, and the pulses are repeatedly applied thereto.

4. An electrophoretic printing method comprising:

layering a back electrode and a dispersion system containing electrophoretic particles on a printing substrate to form a printing layer; and providing a printing head separately from the printing substrate, the printing head having a front electrode which is a counterpart of the back electrode and which has a predetermined printing pattern;

wherein the front electrode is brought into contact with the printing layer formed on the printing substrate to oppose the back electrode, and voltage is applied between the front electrode and the back electrode so as to change a distribution of the electrophoretic particles according to the polarity of the voltage and to form a desired image on the dispersion system; and at least one pre-printing cycle is performed before a desired image is formed on the dispersion system, where, the entire surface of the dispersion system is printed, and then the entire surface of the dispersion system is erased.

5. An electrophoretic printing apparatus for printing on a printing substrate having a printing layer thereon comprising a back electrode and a dispersion system containing electrophoretic particles, the apparatus comprising:

a printing head provided separately from the printing substrate, the printing head having a front electrode which is a counterpart of the back electrode and which has a predetermined printing pattern;

wherein the front electrode is brought into contact with the printing layer formed on the printing substrate to oppose the back electrode, and voltage is applied between the front electrode and the back electrode so as to change a distribution of the electrophoretic particles according to the polarity of the voltage and to form a desired image on the dispersion system; and the front electrode comprises a printing electrode for forming a variable desired image and a marginal electrode disposed around the printing electrode to form a marginal image.

6. An electrophoretic printing apparatus according to claim 5, wherein the front electrode further comprises a contact electrode for applying voltage to the back electrode at substantially the same plane as the printing electrode.

7. An electrophoretic printing apparatus according to claim 5, wherein the voltage applied between the electrodes is divided into pulses, and the pulses are repeatedly applied thereto.

8. An electrophoretic printing apparatus for printing on a printing substrate having a printing layer thereon comprising a back electrode and a dispersion system containing electrophoretic particles, the apparatus comprising:

a printing head provided separately from the printing substrate, the printing head having a front electrode which is a counterpart of the back electrode and which has a predetermined printing pattern;

wherein the front electrode is brought into contact with the printing layer formed on the printing substrate to oppose the back electrode, and voltage is applied between the front electrode and the back electrode so as to change a distribution of the electrophoretic particles according to the polarity of the voltage and to form a desired image on the dispersion system; and at least one pre-printing cycle is performed before a desired image is formed on the dispersion system, where, the entire surface of the dispersion system is printed, and then the entire surface of the dispersion system is erased.

* * * * *